US007841683B2

(12) United States Patent
Miyazawa

(10) Patent No.: US 7,841,683 B2
(45) Date of Patent: Nov. 30, 2010

(54) PRINTING APPARATUS

(75) Inventor: Hiroshi Miyazawa, Okaya (JP)

(73) Assignee: Seiko Corporation, Tokyo (JP)

( * ) Notice: Subject to any disclaimer, the term of this patent is extended or adjusted under 35 U.S.C. 154(b) by 586 days.

(21) Appl. No.: 11/935,927

(22) Filed: Nov. 6, 2007

(65) Prior Publication Data

US 2008/0106565 A1 May 8, 2008

(30) Foreign Application Priority Data

Nov. 8, 2006 (JP) ..... 2006-302743
Oct. 18, 2007 (JP) ..... 2007-270905

(51) Int. Cl.
*B41J 29/387* (2006.01)
*B41J 2/01* (2006.01)

(52) U.S. Cl. ..... 347/16; 347/101

(58) Field of Classification Search ..... None
See application file for complete search history.

(56) References Cited

U.S. PATENT DOCUMENTS

2006/0181015 A1* 8/2006 Takahashi ..... 271/273

FOREIGN PATENT DOCUMENTS

JP 10-265089 10/1998
JP 2000-203009 7/2000
JP 2004-013119 1/2004

* cited by examiner

*Primary Examiner*—Omar Rojas
(74) *Attorney, Agent, or Firm*—Workman Nydegger

(57) ABSTRACT

A printing apparatus which mounts a printing medium on a conveyor belt, conveys it to a printing area, and carries out printing by ejecting a liquid onto the printing medium from nozzles of a liquid ejection head, includes: a tension imparter which imparts tension to the conveyor belt, a tension remover which removes the tension imparted to the conveyor belt by the tension imparter, a conveyance failure detector which detects a printing medium conveyance failure, and a conveyance failure controller which, when the printing medium conveyance failure is detected by the conveyance failure detector, causes the tension remover to remove the tension imparted to the conveyor belt by the tension imparter.

4 Claims, 10 Drawing Sheets

PRINTING APPARATUS

BACKGROUND

1. Technical Field

The present invention relates to a printing apparatus arranged in such a way as to print a predetermined letter and image by ejecting minuscule droplets of liquid from a plurality of nozzles, and forming their microscopic particles (dots) on a printing medium.

2. Related Art

An ink jet printer which is one of printing apparatus of this kind, as it is possible therewith to easily obtain a generally inexpensive and high-quality color print, has come into widespread use among not only offices but also general users, along with a prevalence of a personal computer, a digital camera and the like.

Meanwhile, in the printing apparatus, a failure to convey a printing medium, that is, a so-called paper jam, becomes problematic. Therein, in a printing apparatus described in JP-A-2000-203009, an arrangement is such that, a spur which presses the printing medium being provided on a side of liquid ejection heads, a rotational condition of the spur is detected by an encoder, the printing medium conveyance failure is detected from the rotational condition and, in the event that the printing medium conveyance failure is detected, a rotational drive of a drive motor for a conveyor belt is stopped so as to stop the conveyor belt. Also, in an image forming apparatus described in JP-A-10-265089, an arrangement is such that, in the event that the printing medium conveyance failure is detected, the conveyor belt is stopped by moving one gear of a train of gears of a drive system for the conveyor belt in such a way that the gear is pulled out of the train of gears.

However, in the printing apparatus described in JP-A-2000-203009, as the arrangement is such that the rotational drive of the drive motor is stopped so as to stop the conveyor belt, the large-inertia drive system and drive motor remain connected to the conveyor belt and, even in the event that a friction element, such as a brake, is used as a stopping aid, it is impossible to stop the conveyor belt within a short time. For example, in a line head ink jet printer, as one-pass printing is possible, high-speed printing is carried out and, unless the conveyor belt can be stopped within the short time, the printing medium, which has failed to stop completely and been conveyed to a printing area, hits the liquid ejection heads, or is caught in a gap between the conveyor belt and the liquid ejection heads. As opposed to this, in the image forming apparatus described in JP-A-10-265089, as one gear is pulled out of the train of gears of the drive system, the large-inertia drive motor being cut off from the conveyor belt, it is possible to stop the conveyor belt within a short time. However, in the event that the gear is pulled out of the train of gears, when the gear pulled out is inserted into the train of gears after fixing the paper jam, there is a fear of teeth of the gears interfering with each other and wearing down.

SUMMARY

The invention has an object of providing a printing apparatus with which it is possible, when a paper jam occurs, to stop a conveyor belt within a very short time, and a recovery is easy after fixing the paper jam.

A printing apparatus of the invention, which mounts a printing medium on a conveyor belt, conveys it to a printing area, and carries out printing by ejecting a liquid onto the printing medium from nozzles of a liquid ejection head, includes: a tension imparter which imparts tension to the conveyor belt, a tension remover which removes the tension imparted to the conveyor belt by the tension imparter, a conveyance failure detector which detects a printing medium conveyance failure, and a conveyance failure controller which, when the printing medium conveyance failure is detected by the conveyance failure detector, causes the tension remover to remove the tension imparted to the conveyor belt by the tension imparter.

According to the printing apparatus of the invention, when the paper jam occurs, a large-inertia drive system and drive motor are completely cut off from the conveyor belt and, as well as it being possible to stop the small-inertia conveyor belt, which has lost a drive force, within the very short time, the recovery is easy after fixing the paper jam.

Furthermore, it is preferable that the conveyance failure controller, after causing the tension remover to remove the tension imparted to the conveyor belt by the tension imparter, stops a rotational drive of the conveyor belt.

According to the printing apparatus, it is possible to, as well as reliably stopping the conveyor belt, control and prevent a slippage between the stopped conveyor belt and the conveyor belt drive system.

Furthermore, it is preferable that the tension imparter is a tension roller.

Furthermore, it is preferable that the tension remover removes the tension imparted to the conveyor belt by moving the tension roller in a direction away from the conveyor belt.

According to the printing apparatus of the invention, the recovery after fixing the paper jam is very easy.

DESCRIPTION OF EXEMPLARY EMBODIMENTS

Figure 1A:
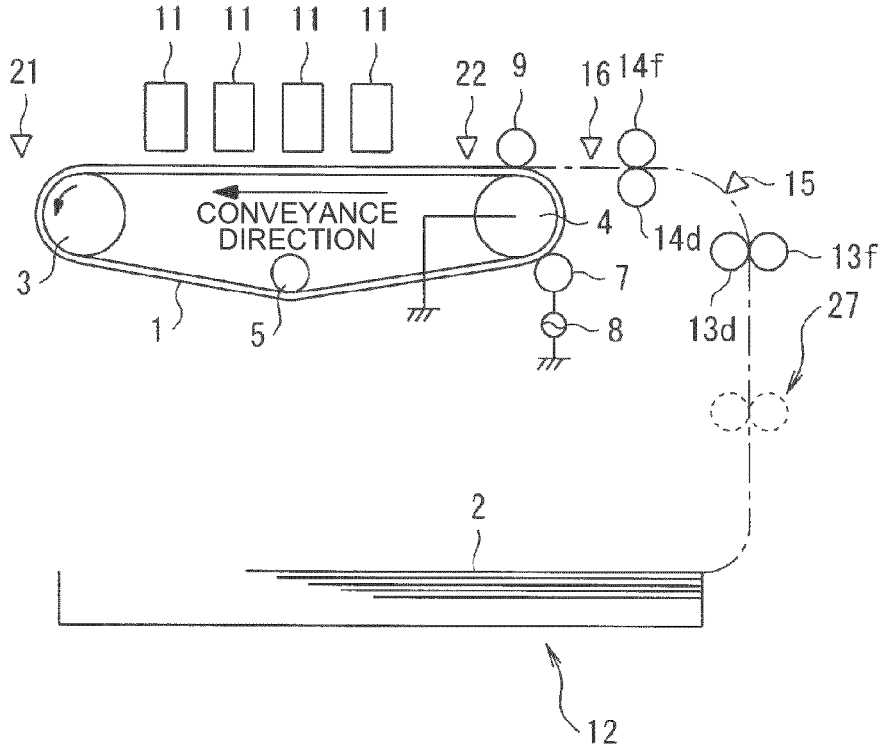
FIG. 1 shows schematic configuration diagrams showing an embodiment of a printing apparatus of the invention, where (a) is a front view, and (b) is a plan view.

Next, a description will be given of an embodiment of a printing apparatus of the invention, while referring to the drawings.

Figure 1B:
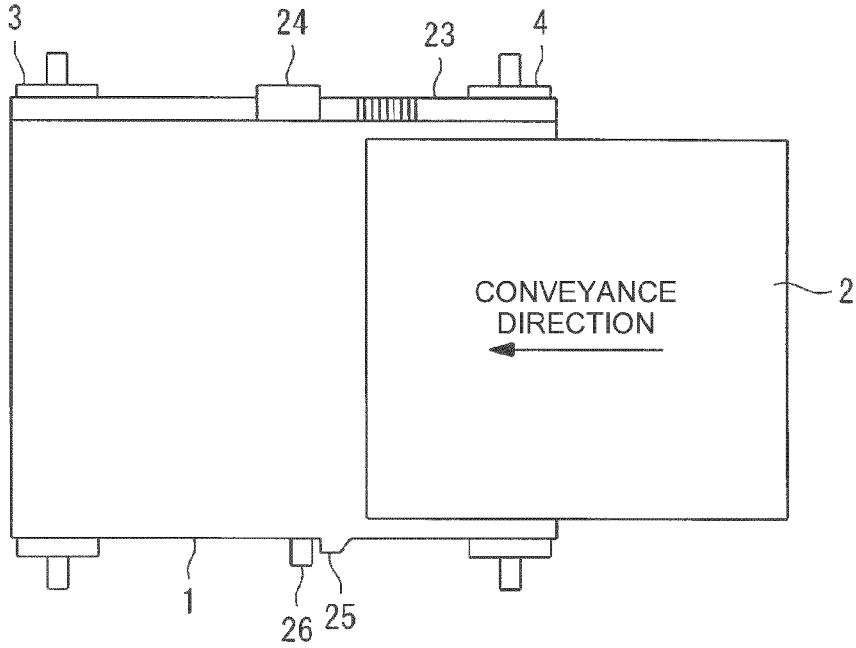

FIG. 1 being schematic configuration diagram of the printing apparatus of the embodiment, FIG. 1*a* is a front view of the printing apparatus of the embodiment, and FIG. 1*b* is a plan view thereof. Reference numeral 1 in the figures is a conveyor belt for conveying a printing medium 2, such as printing paper. The conveyor belt 1 is wound around a drive roller 3 disposed at a left end as seen in the figures, a driven roller 4 disposed at a right end as seen in the figures, and a tension roller 5 disposed in a central lower portion between them. The drive roller 3 is rotationally driven in a direction of the arrow of the figure by an unshown conveyor motor and, in a condition in which the printing medium 2 is adsorbed to the conveyor belt 1 charged by a charging roller, to be described hereafter, conveys the printing medium 2 from a right to a left as seen in the figures, that is, in an arrowed direction. The driven roller 4 holds the conveyor belt 1 between itself and an abutment portion of the charging roller, to be described hereafter, and is grounded as a voltage is applied thereto.

Figure 2A:
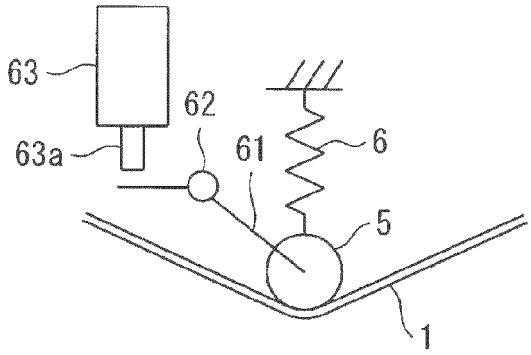
FIGS. 2(*a*)-2(*b*) are illustrations of a tension roller of FIG. 1.
Figure 2B:
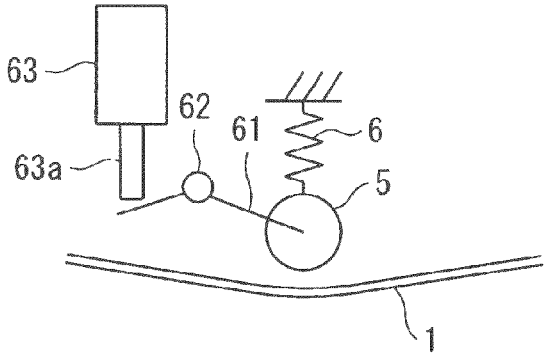

The tension roller 5, being disposed inside the conveyor belt 1, is urged downward by a spring 6, as shown in FIG. 2, and thereby imparts tension to the conveyor belt 1. A rotary shaft of the tension roller 5 is connected to one end of a pivot arm 61, a central portion of the pivot arm 61 is rotatably attached to a pivot shaft 62, and the other end of the pivot arm 61 is opposed or connected to a rod 63*a* of a tension solenoid 63. In a condition in which the tension solenoid 63 is not energized, the rod 63*a* is retracted therein and, in a condition in which it is energized, moves downward as seen in the figures. Consequently, in a normal condition in which the tension solenoid 63 is not energized, as shown in FIG. 2*a*, as the rod 63*a* is retracted therein, the other end of the pivot arm 61 is raised, and the one end of the pivot arm 61 is lowered. When the tension solenoid 63 is energized in this condition, as shown in FIG. 2*b*, the rod 63*a* moves downward to lower the other end of the pivot arm 61, the pivot arm 61 rotates counterclockwise around the rotary shaft 62, and the one end of the pivot arm 61 moves up. When the one end of the pivot arm 61 moves up, the tension roller 5 connected thereto is moved in a direction away from the conveyor belt 1, as a result of which the tension imparted to the conveyor belt 1 by the tension roller 5 is removed. When the tension imparted is removed in such a way as to separate the tension roller 5 from the conveyor belt 1 which is rotating with the tension imparted thereto by the tension roller 5, the small-inertia conveyor belt 1 stops immediately.

The charging roller 7, acting as a charging unit, is placed in abutment with the conveyor belt 1 in such a way as to be opposed to the driven roller 4, and an approximate 10 to 50 Hz alternator 8 is connected to the charging roller 7. A location of the charging roller 7 corresponds to a portion immediately before a printing medium 2 feed position. The charging roller 7 electrostatically charges a surface of the conveyor belt 1, configured of a mid to high resistance body, by charging it with an electric charge, generates a dielectric polarization in the printing medium 2 by means of the electric charge, and adsorbs the printing medium 2 to the surface of the conveyor belt 1 by means of an electrostatic force between an electric charge of the printing medium 2, generated due to the dielectric polarization, and an electric charge of a dielectric portion on the surface of the conveyor belt 1. The charging roller 7 is pressed by an unshown spring against the conveyor belt 1.

A pressure roller 9 is disposed above the driven roller 4. The pressure roller 9, being configured in such a way as to be pressed downward, that is, toward the driven roller 4, by an unshown pressure solenoid, has a function of pressing the printing medium 2 against the conveyor belt 1 on the driven roller 4. As described heretofore, when the printing medium 2 is mounted on a charged outer peripheral surface of the conveyor belt 1, and when the printing medium 2 is pressed against the conveyor belt 1 by the pressure roller 9, the printing medium 2 is adsorbed to the outer peripheral surface of the conveyor belt 1 due to the dielectric polarization.

Reference numeral 11 in FIG. 1 depicts liquid ejection heads. The liquid ejection heads 11 are disposed, staggered in a direction of conveyance of the printing medium 2, one for each of four colors, yellow (Y), magenta (M), cyan (C) and black (K). A liquid is supplied to each liquid ejection head 11 via a liquid supply tube from an unshown liquid tank of each color. A plurality of nozzles are formed in each liquid ejection head 11 in a direction crossing the direction of conveyance of the printing medium 2 and, by necessary amounts of liquid being ejected onto necessary points from the nozzles at the same time, minute liquid dots are output onto and formed on the printing medium 2. By carrying out this operation for each color, it is possible to carry out so-called one-pass printing merely by causing one passage of the printing medium 2 adsorbed to the conveyor belt 1. That is, a disposition area of the liquid ejection heads 11 corresponds to a printing area.

As methods of ejecting the liquid from the nozzles of the liquid ejection heads, there are an electrostatic method, a piezoelectric method, a film boiling jet method and the like. The electrostatic method is one by which, when a drive pulse is applied to an electrostatic gap which is an actuator, a vibrating plate in a cavity is displaced to cause a pressure change in the cavity, and the liquid is ejected from the nozzles due to the pressure change. The piezoelectric method is one by which, when a drive pulse is applied to a piezoelectric element which is an actuator, a vibrating plate in a cavity is displaced to cause a pressure change in the cavity, and the liquid is ejected from the nozzles due to the pressure change. The film boiling jet method is one by which, there being a minute heater in a cavity, the liquid is instantaneously heated to 300° C. or higher into a film boiling condition, air bubbles are generated, and the liquid is ejected from the nozzles due to a pressure change caused by the generation of the air bubbles. The invention is applicable to any one of the liquid ejection methods.

A discharge paper sensor 21 for detecting the printing medium 2 to be discharged into a paper discharge portion is disposed downstream of the drive roller 3 in the printing medium conveyance direction. Also, a feed paper sensor 22 for detecting the printing medium 2 to be conveyed to the printing area of the liquid ejection heads 11 is disposed upstream of the liquid ejection heads 11 in the printing medium conveyance direction. Also, a linear scale 23 is affixed to a circumferential surface of the conveyor belt 1, and a belt encoder 24 which reads the linear scale 23 is disposed. Also, a belt index 25 is formed protruding from one portion of a widthwise side of the conveyor belt 1, and a belt index sensor 26, such as an optical sensor, which detects the belt index 25 is disposed.

Figure 3:
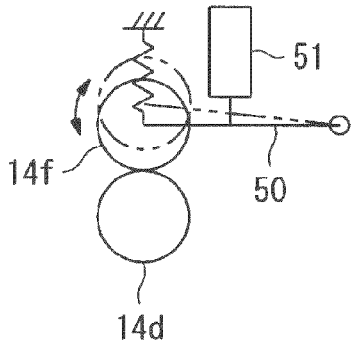
FIG. 3 is an illustration of a register roller of FIG. 1.

The printing medium 2 to be fed being stored in a paper feeder 12, feed rollers 13*d* and 13*f* which feed the printing medium 2 in the paper feeder 12 are disposed ahead of the paper feeder 12 in the printing medium conveyance direction, and register rollers 14*d* and 14*f* are disposed ahead of the feed rollers 13*d* and 13*f* in the printing medium conveyance direction. The register rollers 14*d* and 14*f* are for, as well as correcting a position of the printing medium 2 abutted thereagainst by the feed rollers 13*d* and 13*f*, adjusting a timing of conveyance of the printing medium 2. Of these register rollers 14*d* and 14*f*, as shown in FIG. 3, one register roller 14*d* is driven by an unshown stepping motor, and the other register roller 14*f* is driven by the drive register roller 14*d*. A pivot arm 50 is attached to the driven register roller 14*f*, and a register solenoid 51 is attached to the pivot arm 50. When the register solenoid 51 is driven, the pivot arm 50 is pivoted, along with which the driven register roller 14*f* moves up and down as seen in the figure. Consequently, the driven register roller 14*f*, when positioned in a lower position as seen in the figure, is in abutment with the drive register roller 14*d* (there is also a case in which the printing medium 2 is interposed therebetween) and, when positioned in an upper position as seen in the figure, is separate from the drive register roller 14. This structure is the same as that of the feed rollers 13*d* and 13*f*.

A pre-register sensor 15 is disposed upstream of the register rollers 14*d* and 14*f* in the printing medium conveyance direction, and a register sensor 16 is disposed ahead of the register rollers 14*d* and 14*f* in the printing medium conveyance direction. Both the pre-register sensor 15 and the register sensor 16, being for detecting the printing medium 2, are turned on when the printing medium 2 is conveyed to sensor positions.

Figure 4:
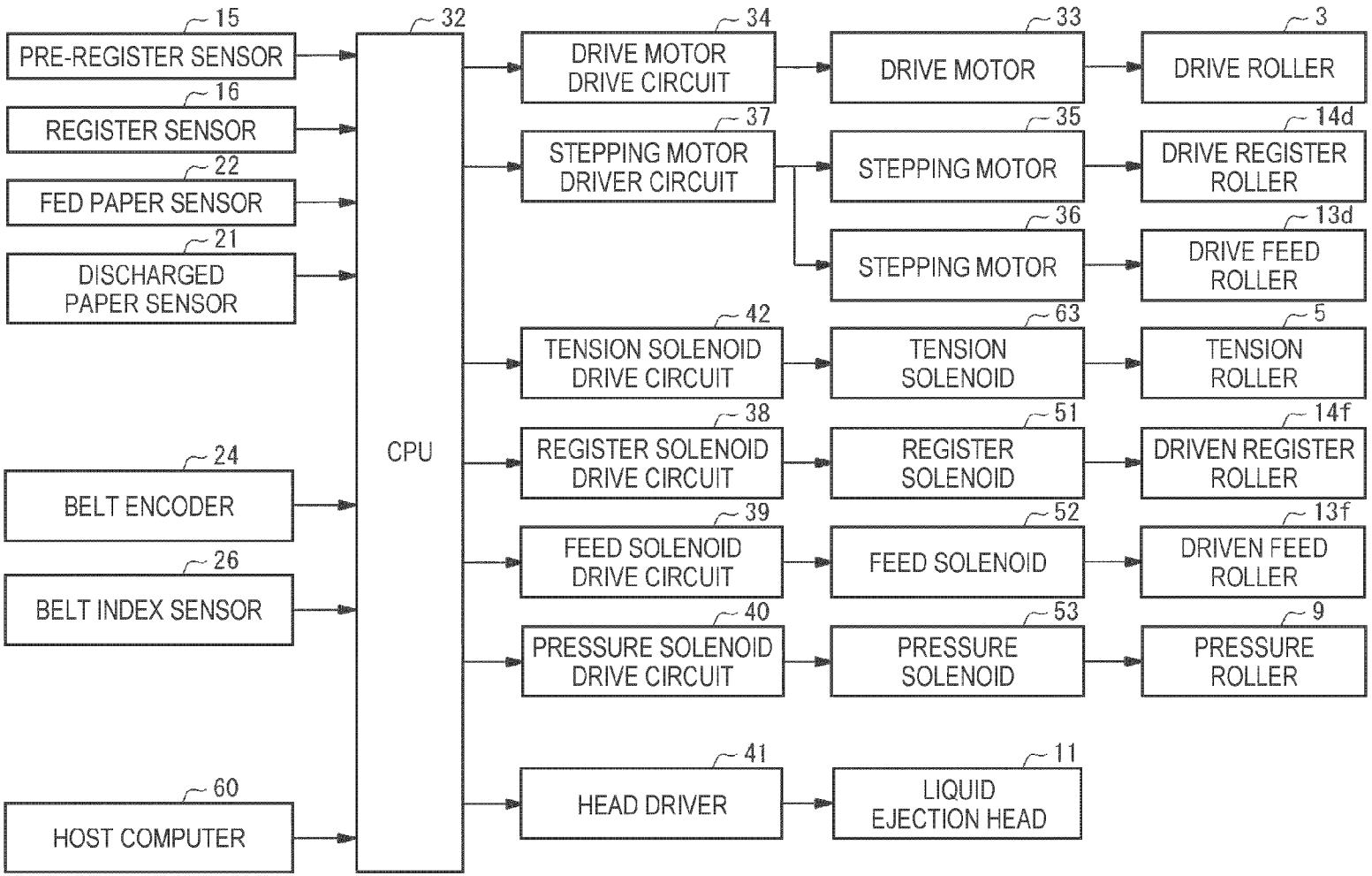
FIG. 4 is a block diagram showing a controller of the printing apparatus of FIG. 1.

FIG. 4 shows a controller which controls the printing apparatus of the embodiment. The controller, in which is incorporated a computer system as a calculation processor, includes a CPU 32 which is a central processing unit carrying out various kinds of control and calculation process. Also, as drive circuits which drive actual devices based on results of the calculation processes of the CPU 32, the controller includes a drive motor drive circuit 34 which drives and controls a drive motor 33 for driving the drive roller 3, a stepping motor drive circuit 37 which drives and controls a stepping motor 35 for driving the drive register roller 14*d*, and a stepping motor 36 for driving the drive feed roller 13*d*, a tension solenoid drive circuit 42 which drives and controls a tension solenoid 63 for moving the tension roller 5, a register solenoid drive circuit 38 which drives and controls the register solenoid 51 for moving the driven register roller 14*f*, a feed solenoid drive circuit 39 which drives and controls a feed solenoid 52 for moving the driven feed roller 13*f*, a pressure solenoid drive circuit 40 which drives and controls a pressure solenoid 53 for moving the pressure roller 9, and a head driver 41 which drives and controls the liquid ejection heads 11. Also, outputs from the pre-register sensor 15, register sensor 16, feed paper sensor 22, discharge paper sensor 21, belt index sensor 26 and belt encoder 24 are also input into the CPU 32. Also, printing image data are input into the CPU 32 from a host computer 60.

In the controller, upon acquiring the printing image data from the host computer 60 via an unshown interface, the CPU 32 executes a predetermined process on the printing image data and, based on the processed data and the input data from each kind of sensor, outputs control signals to the drive circuits and the driver. The drive circuits and the driver output drive signals for their devices, and the actuators, solenoids and motors corresponding to the plurality of nozzles of the liquid ejection heads 11 are operated to execute a printing process on the printing medium 2. The components in the controller are electrically connected via an unshown bus.

Figure 5:
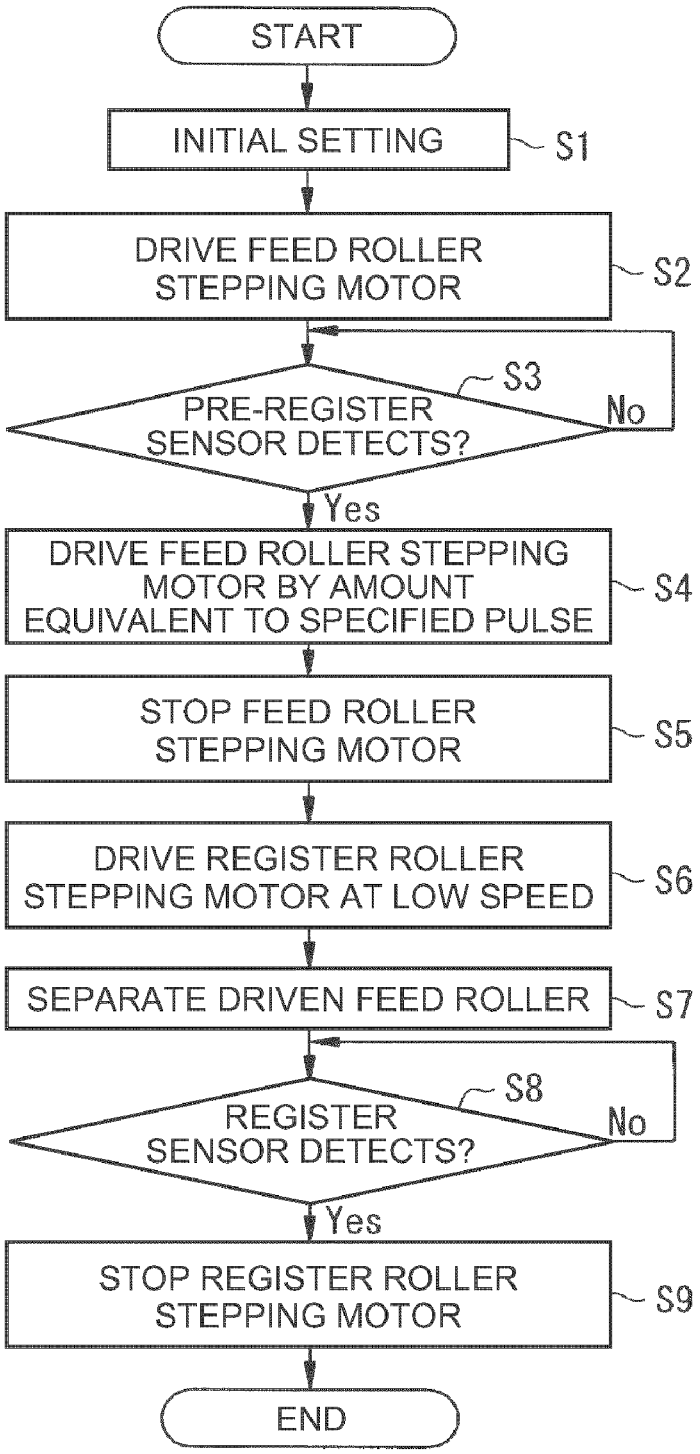
FIG. 5 is a flowchart of a calculation process carried out by a CPU of FIG. 4.

Next, a description will be given, using the flowchart of FIG. 5, of a calculation process, from among the calculation processes carried out in the CPU 32 of the controller, up until the printing medium 2 in the paper feeder 12 is nipped between the register rollers 14*d* and 14*f* into a conveyance standby condition. In the calculation process, first, in step S1, an initial setting is carried out for each kind of solenoid and motor.

Next, the process shifts to step S2, and drives the feed roller stepping motor 36 at a printing medium conveyance speed.

Next, the process shifts to step S3, and determines whether or not the pre-register sensor 15 has detected the printing medium 2. If the pre-register sensor 15 has detected the printing medium 2, the process shifts to step S4 and, if not, stands by.

In step S4, the process drives the feed roller stepping motor 36, by an amount equivalent to a predetermined pulse, at the printing medium conveyance speed to abut the printing medium 2 against the register rollers 14*d* and 14*f*, and furthermore, bend the printing medium 2.

Next, the process shifts to step S5, and stops the feed roller stepping motor 36.

Next, the process shifts to step S6, and drives the register roller stepping motor 35 at a low speed which is lower than the printing medium conveyance speed.

Next, the process shifts to step S7 and, by retracting the feed solenoid 52, separates the driven feed roller 13*f* from the drive feed roller 13*d*.

Next, the process shifts to step S8, and determines whether or not the register sensor 16 has detected the printing medium 2. If the register sensor 16 has detected the printing medium 2, the process shifts to step S9 and, if not, stands by.

In step S9, the process, after stopping the register roller stepping motor 35, returns to a main program.

Next, a description will be given, using the flowchart of FIG. 6, of a calculation process, from among the calculation processes carried out in the CPU 32 of the controller, from the conveyance standby condition, in which the printing medium 2 is nipped between the register rollers 14*d* and 14*f*, until the printing process is carried out and the printing medium discharged. In the calculation process, first, in step S11, the process determines whether or not the belt index sensor 26 has detected the belt index 25. If the belt index sensor 26 has detected the belt index 25, the process shifts to step S12 and, if not, stands by.

In step S12, the process carries out a printing position adjustment of the printing medium 2.

Next, the process shifts to step S13, and drives the register roller stepping motor 35 at the printing medium conveyance speed.

Next, the process shifts to step S14 and, by retracting the register solenoid 51, separates the driven register roller 14*f* from the drive register roller 14*d*.

Figure 6:
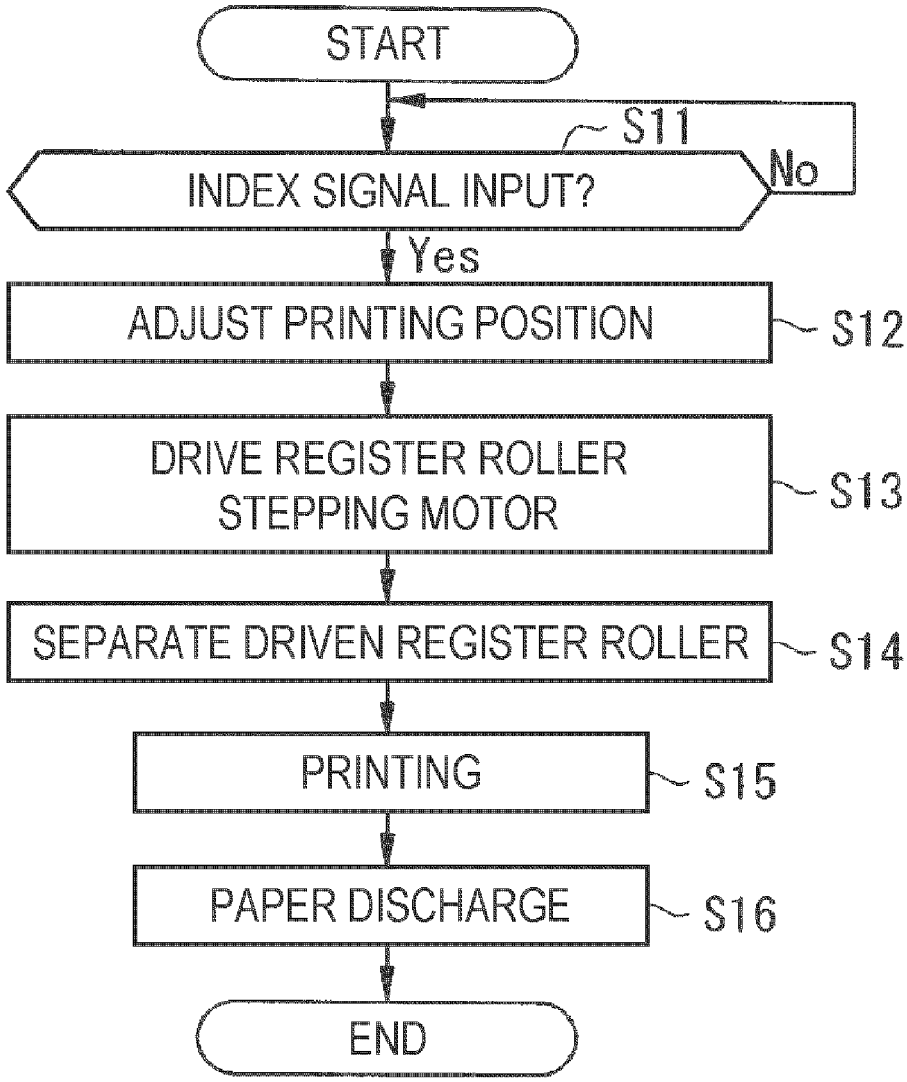
FIG. 6 is a flowchart of a calculation process carried out by the CPU of FIG. 4.

Next, the process shifts to step S15 and, by carrying out a calculation process of FIG. 6, to be described hereafter, carries out the printing process.

Next, the process shifts to step S16 and, after discharging the printing medium 2 by means of an unshown paper discharge roller, returns to the main program.

Next, a description will be given, using the flowchart of FIG. 7, of a calculation process of the printing process carried out in step S15 of the calculation process of FIG. 6. In the calculation process, first, in step S31, the process determines whether or not the belt index sensor 26 has detected the belt index 25. If the belt index sensor 26 has detected the belt index 25, the process shifts to step S32 and, if not, stands by.

In step S32, the process resets a counter which counts signals from the belt encoder 24.

Next, the process shifts to step S33, and counts the signals from the belt encoder 24.

Next, the process shifts to step S34, and determines whether or not the counted signals from the belt encoder 24 have reached a predetermined value, and a printing start position has been reached. If the printing start position has been reached, the process shifts to step S35 and, if not, shifts to step S33.

In step S35, the process drives the liquid ejection heads 11 to eject the liquid from predetermined nozzles.

Next, the process shifts to step S36, and determines whether or not printing of all the printing image data is finished. If the printing of all the printing image data is finished, the process shifts to step S16 of the calculation process of FIG. 6 and, if not, shifts to step S35.

Figure 7:
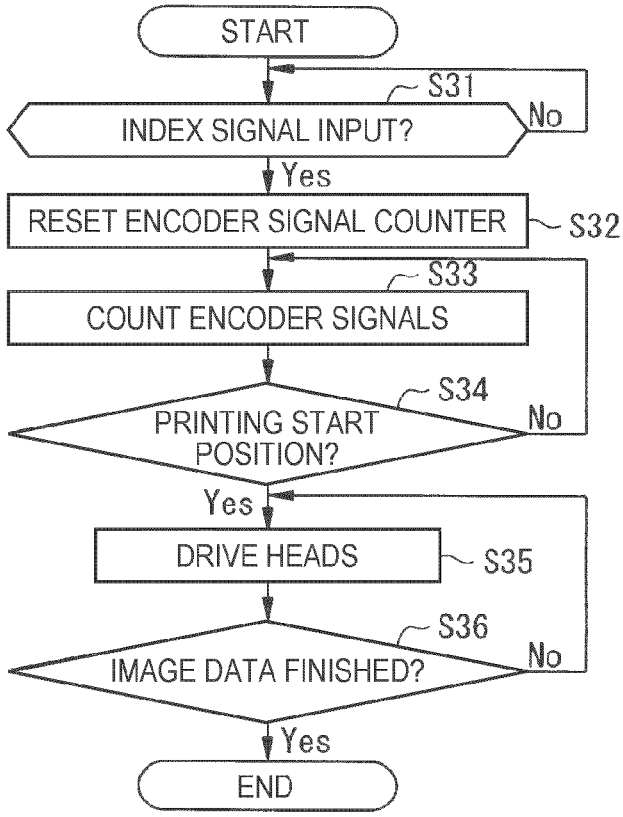
FIG. 7 is a flowchart of a sub-routine carried out by the calculation process of FIG. 6.

Of these processes, the printing medium 2 conveyance, printing and discharge processes by means of the calculation processes of FIGS. 6 and 7 are the same as the existing ones. Meanwhile, the process according to the calculation process of FIG. 5, by which the printing medium 2 from the paper feeder 12 is nipped between the register rollers 14*d* and 14*f* into the conveyance standby condition, is a feature of the embodiment. That is, in the embodiment, the feed rollers 13*d* and 13*f* abut the printing medium 2 against the register rollers 14*d* and 14*f* and, after the feed rollers 13*d* and 13*f* are further driven to bend the printing medium 2, as well as the register rollers 14*d* and 14*f* being driven at a low speed which is lower than a predetermined printing medium conveyance speed, the driven feed roller 13*f* is separated therefrom. Then, in the event that the register sensor 16 detects a leading end of the printing medium 2, the register rollers 14*d* and 14*f* are stopped temporarily, and the process stands by in a condition in which the leading end of the printing medium 2 is nipped between the register rollers 14*d* and 14*f*. Subsequently, the register rollers 14*d* and 14*f* are driven at the predetermined printing medium conveyance speed to feed the printing medium 2 onto the conveyor belt 1.

Figure 8:
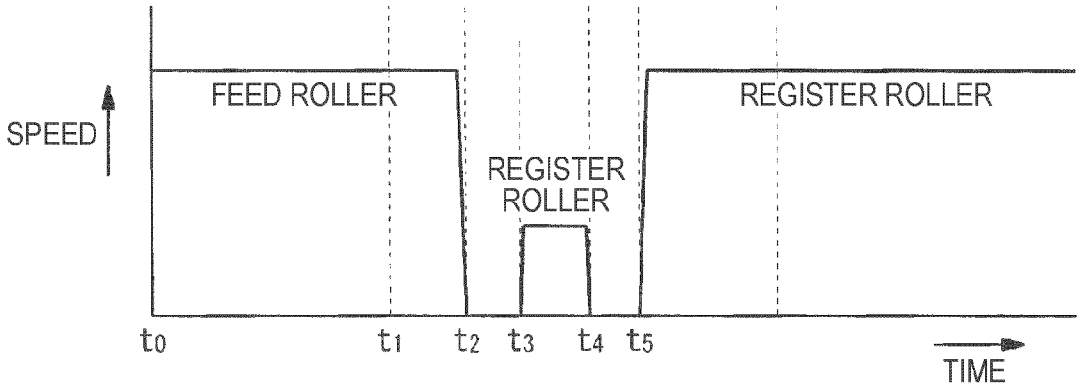
FIG. 8 is an illustration of an operation of the calculation process of FIG. 5.

In FIG. 8, the printing medium conveyance condition is represented by the speeds of the feed rollers 13*d* and 13*f* and the register rollers 14*d* and 14*f*. For example, the feed rollers 13*d* and 13*f* start to be driven at a time t0 and, in the event that the pre-register sensor 15 detects the printing medium 2 at a time t1, after that, the feed roller stepping motor 36 is driven by an amount equivalent to a specified pulse to abut the printing medium 2 against the register rollers 14*d* and 14*f*, and furthermore, bend the printing medium 2. After the printing medium 2 is bent, the feed rollers 13*d* and 13*f* are stopped at a time t2 and, after that, the register rollers 14*d* and 14*f* are driven at the low speed at a time t3. By this means, the printing medium 2 is unbent and, as well as the position of the printing medium 2 being corrected, the leading end of the printing medium 2 is reliably nipped between the register rollers 14*d* and 14*f*. Continuing, in the event that the register sensor 16 detects the printing medium 2 at a time t4, the register rollers 14*d* and 14*f* are stopped temporarily, and the process stands by in the condition in which the leading end of the printing medium 2 is nipped between the register rollers 14*d* and 14*f*. Subsequently, at a time t5, the register rollers 14*d* and 14*f* are driven at the predetermined printing medium conveyance speed to feed the printing medium 2 onto the conveyor belt 1.

Figure 9:
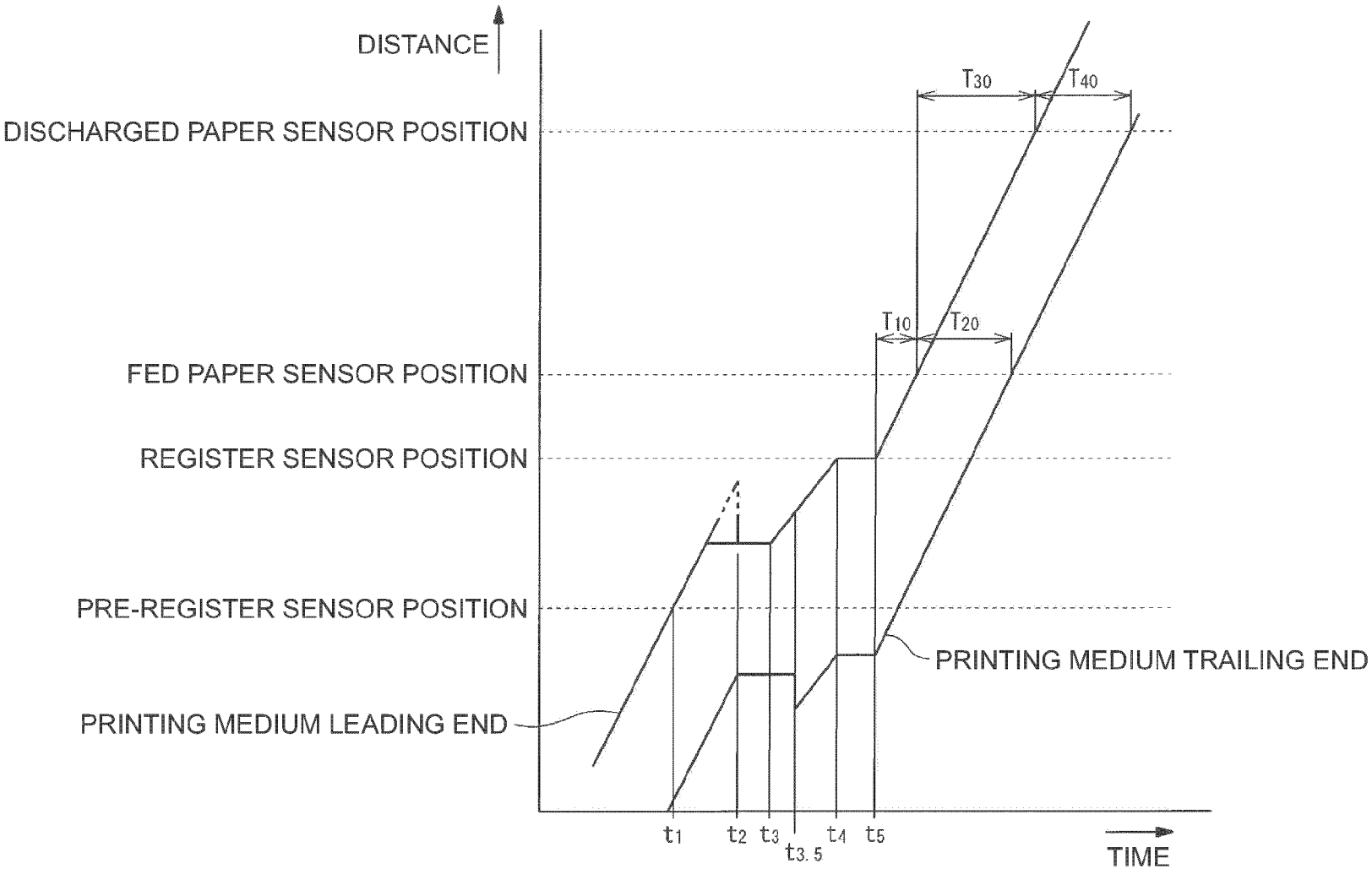
FIG. 9 is an illustration of operations of the calculation processes of FIGS. 5 to 7.

In FIG. 9, a moving trajectory from the feed to the discharge of one printing medium 2 is represented as a moving distance of a conveyance-direction leading end and trailing end of the printing medium 2. Times correspond to those of FIG. 8. In the figure, times t3 and t5 are times at which the driven feed roller 13*f* is separated from the drive feed roller 13*d* and, as a result, the printing medium 2 is unbent, and the conveyance-direction trailing end of the printing medium 2 withdraws backward in the conveyance direction, at which time the position of the printing medium 2 is corrected.

Figure 10:
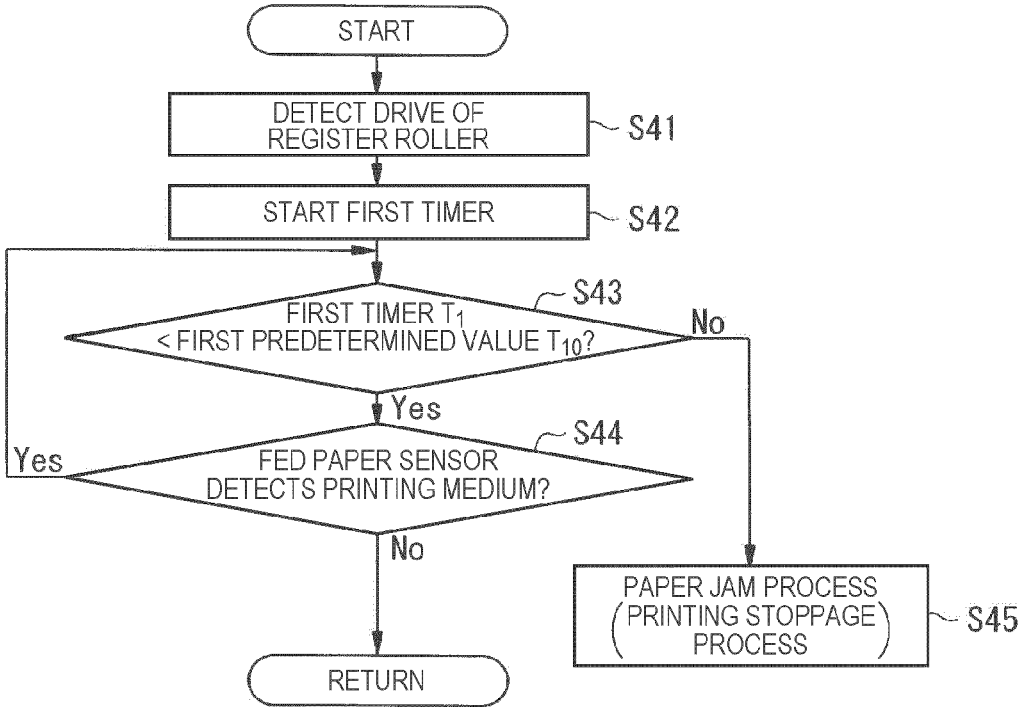
FIG. 10 is a flowchart of a calculation process for detecting a printing medium conveyance failure.

Next, a description will be given of a calculation process of FIG. 10 which is carried out in parallel with each heretofore described calculation process, and in unique sampling periods. The calculation process, being for stopping the printing process in the event that a printing medium conveyance failure, that is, a so-called paper jam, occurs between the register rollers 14*d* and 14*f* and the feed paper sensor 22, first, in step S41, detects the drive of the register rollers 14*d* and 14*f* in step S13 of the calculation process of FIG. 6.

Next, the process shifts to step S42, and starts a first timer $T_1$.

Next, the process shifts to step S43, and determines whether or not the first timer $T_1$ is at less than a first predetermined value $T_{10}$. If the first timer $T_1$ is at less than the first predetermined value $T_{10}$, the process shifts to step S44, and if not, that is, if the first timer $T_1$ is at, or greater than, the first predetermined value $T_{10}$, shifts to step S45. The first predetermined value $T_{10}$ corresponds to a conveyance time required for the conveyance-direction leading end of the printing medium 2 conveyed at the predetermined conveyance speed to move from a register sensor position (in the embodiment, the conveyance-direction leading end of the printing medium 2 stops temporarily at the register sensor position) to a feed paper sensor position, as shown in FIG. 9. That is, the first predetermined value $T_{10}$ is stored as a constant determined by a distance between the register sensor position and the feed paper sensor position, and by the predetermined conveyance speed.

In step S44, the process determines whether or not the feed paper sensor 22 has detected the printing medium 2. If the feed paper sensor 22 has detected the printing medium 2, the process shifts to step S43 and, if not, returns to the main program.

Figure 14:
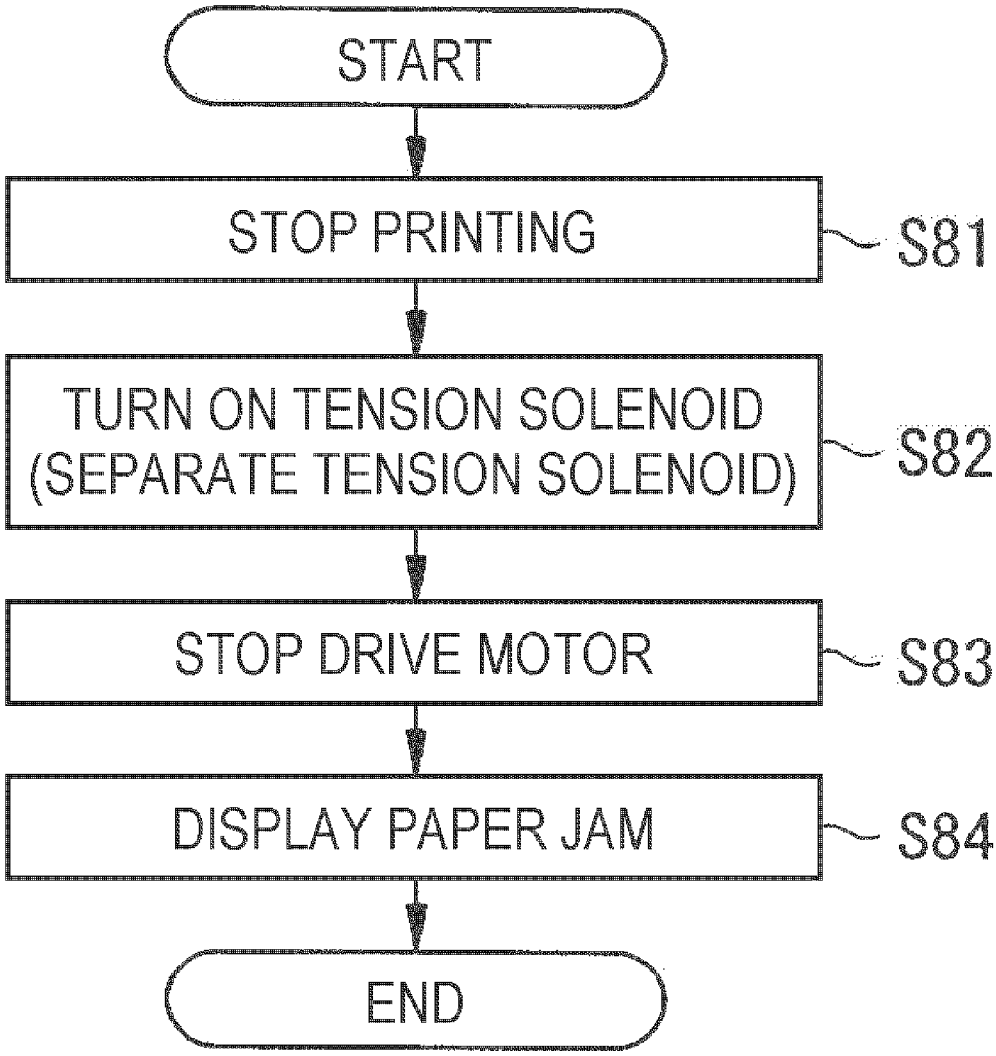
FIG. 14 is a flowchart of a calculation process for a paper jam process carried out by the calculation processes of FIGS. 10 to 13.

Meanwhile, in step S45, supposing that the printing medium conveyance failure, that is, the so-called paper jam, occurs between the register rollers 14*d* and 14*f* and the feed paper sensor 22, a calculation process of FIG. 14, to be described hereafter, stops the printing process.

According to the calculation process, a conveyance time required from driving the register rollers 14*d* and 14*f* until the feed paper sensor 22 detects the printing medium is detected by the first timer $T_1$ and, when the required conveyance time is the first predetermined value (predetermined time) $T_{10}$ set in advance, or greater, the process determines that the printing medium conveyance failure has occurred, and stops the printing process.

Figure 11:
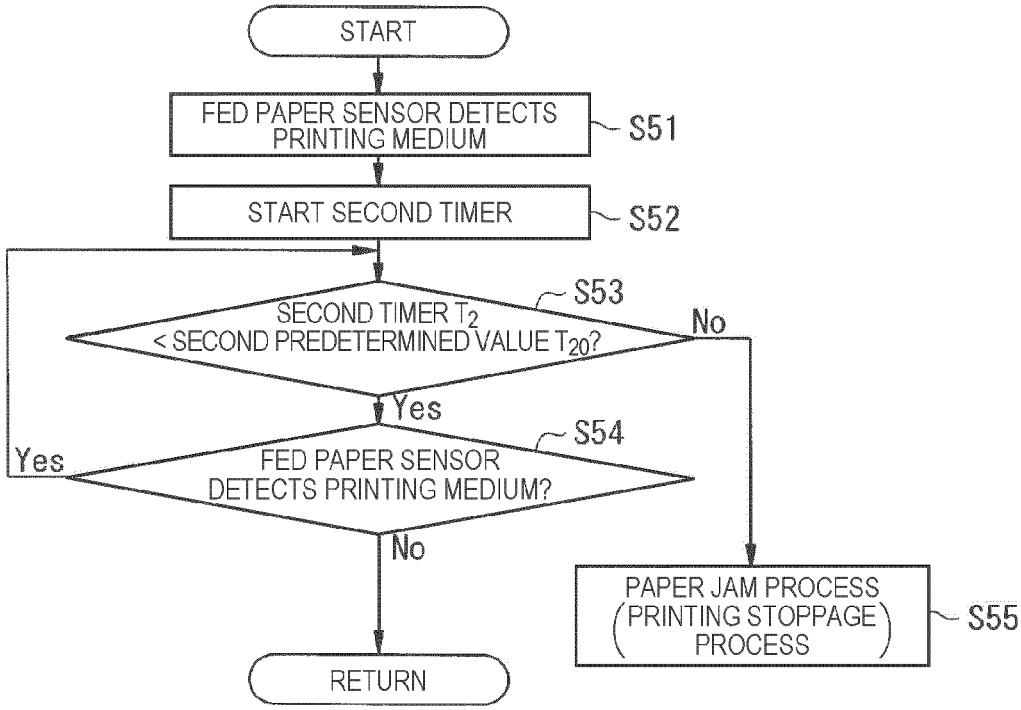
FIG. 11 is a flowchart of a calculation process for detecting the printing medium conveyance failure.

Next, a description will be given of a calculation process of FIG. 11 which is carried out in parallel with each heretofore described calculation process, and in unique sampling periods. The calculation process, being for stopping the printing process in the event that the conveyance failure, that is, the so-called paper jam, occurs in the printing medium passing through the feed paper sensor 22, first, in step S51, reads a detection of the conveyance-direction leading end of the printing medium 2 by the feed paper sensor 22.

Next, the process shifts to step S52, and starts a second timer $T_2$.

Next, the process shifts to step S53, and determines whether or not the second timer $T_2$ is at less than a second predetermined value $T_{20}$. If the second timer $T_2$ is at less than a second predetermined value $T_{20}$, the process shifts to step S54, and if not, that is, if the second timer $T_2$ is at, or greater than, the second predetermined value $T_{20}$, shifts to step S55. The second predetermined value $T_{20}$ is set at a predetermined conveyance time for which, as shown in FIG. 9, when the printing medium 2 is being conveyed at the predetermined conveyance speed, the conveyance-direction leading end and trailing end of the printing medium 2 set for the printing process pass through the position of the feed paper sensor 22. That is, a conveyance-direction length of the printing medium 2 set for the printing process is obtained by multiplying the required conveyance time by the printing medium conveyance speed. The second predetermined value $T_{20}$ is stored in a memory of the controller for each conveyance-direction length of the printing medium 2 set for the printing process.

In step S54, the process determines whether or not the feed paper sensor 22 has detected the printing medium 2. If the feed paper sensor 22 has detected the printing medium 2, the process shifts to step S53 and, if not, returns to the main program.

Meanwhile, in step S55, supposing that the conveyance failure, that is, the so-called paper jam, occurs in the printing medium passing through the feed paper sensor 22, the calculation process of FIG. 14, to be described hereafter, stops the printing process.

According to the calculation process, a conveyance time required from the feed paper sensor 22 detecting the conveyance-direction leading end of the printing medium 2 until it detects the conveyance-direction trailing end of the relevant printing medium 2 is detected by the second timer $T_2$ and, when the required conveyance time is the second predetermined value (predetermined time) $T_{20}$ set in advance, or greater, the process determines that the printing medium conveyance failure has occurred, and stops the printing process.

Figure 12:
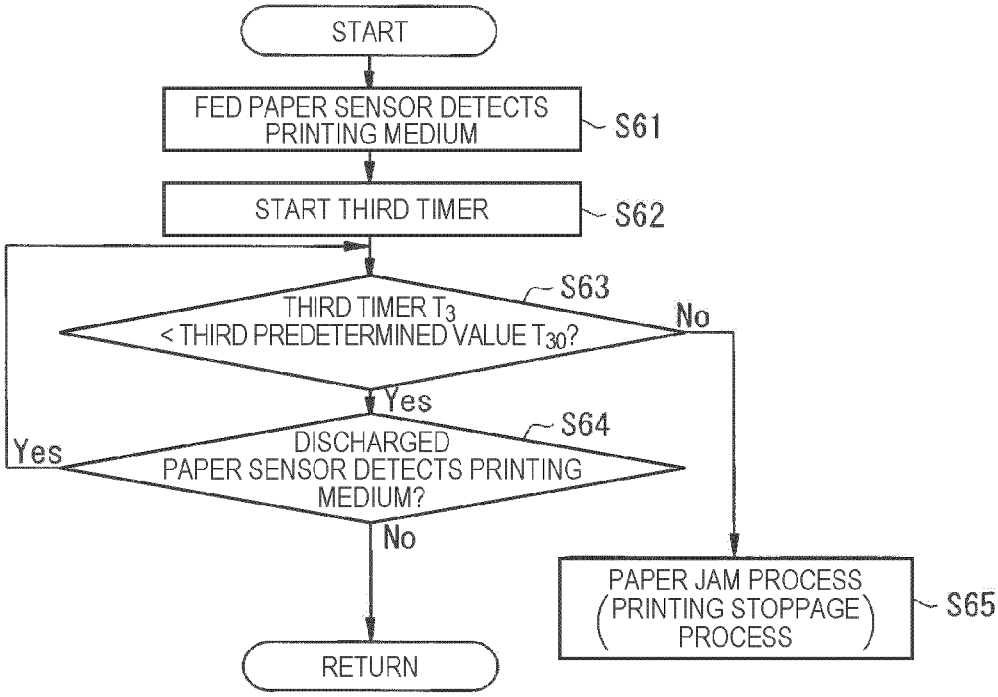
FIG. 12 is a flowchart of a calculation process for detecting the printing medium conveyance failure.

Next, a description will be given of a calculation process of FIG. 12 which is carried out in parallel with each heretofore described calculation process, and in unique sampling periods. The calculation process, being for stopping the printing process in the event that the printing medium conveyance failure, that is, the so-called paper jam, occurs between the feed paper sensor 22 and the discharge paper sensor 21, first, in step S61, reads the detection of the conveyance-direction leading end of the printing medium 2 by the feed paper sensor 22.

Next, the process shifts to step S62, and starts a third timer $T_3$.

Next, the process shifts to step S63, and determines whether or not the third timer $T_3$ is at less than a third predetermined value $T_{30}$. If the third timer $T_3$ is at less than the third predetermined value $T_{30}$, the process shifts to step S64, and if not, that is, if the third timer $T_3$ is at, or greater than, the third predetermined value $T_{30}$, shifts to step S55. The third predetermined value $T_{30}$ corresponds to a conveyance time required for the conveyance-direction leading end of the printing medium 2 conveyed at the predetermined conveyance speed to move from the feed paper sensor position to the discharge paper sensor position, as shown in FIG. 9. That is, the third predetermined value $T_{30}$ is stored as a constant determined by a distance between the feed paper sensor position and the discharge paper sensor position, and by the predetermined conveyance speed.

In step S64, the process determines whether or not the discharge paper sensor 21 has detected the printing medium 2. If the discharge paper sensor 21 has detected the printing medium 2, the process shifts to step S63 and, if not, returns to the main program.

Meanwhile, in step S65, supposing that the printing medium conveyance failure, that is, the so-called paper jam, occurs between the feed paper sensor 22 and the discharge paper sensor 21, the calculation process of FIG. 14, to be described hereafter, stops the printing process.

According to the calculation process, a required conveyance time from the feed paper sensor 22 detecting the printing medium 2 until the discharge paper sensor 21 detects the printing medium 2 is detected by the third timer $T_3$ and, when the required conveyance time is the third predetermined value (predetermined time) $T_{30}$ set in advance, or greater, the process determines that the printing medium conveyance failure has occurred, and stops the printing process.

Figure 13:
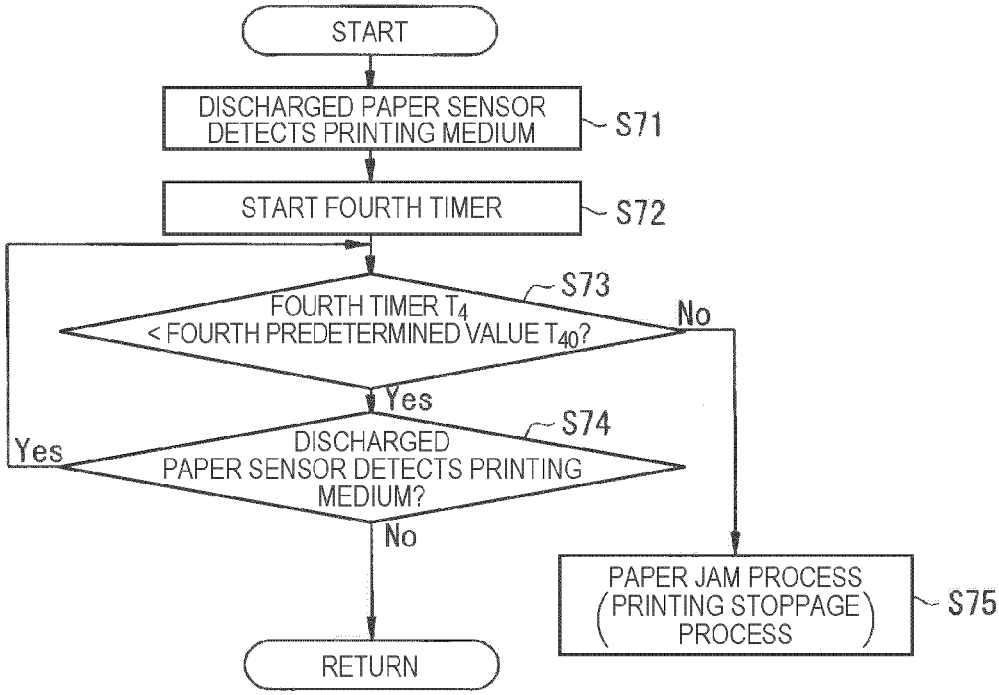
FIG. 13 is a flowchart of a calculation process for detecting the printing medium conveyance failure.

Next, a description will be given of a calculation process of FIG. 13 which is carried out in parallel with each heretofore described calculation process, and in unique sampling periods. The calculation process, being for stopping the printing process in the event that the conveyance failure, that is, the so-called paper jam, occurs in the printing medium passing through the discharge paper sensor 21, first, in step S71, reads a detection of the conveyance-direction leading end of the printing medium 2 by the discharge paper sensor 21.

Next, the process shifts to step S72, and starts a fourth timer $T_4$.

Next, the process shifts to step S73, and determines whether or not the fourth timer $T_4$ is at less than a fourth predetermined value $T_{40}$. If the fourth timer $T_4$ is at less than the fourth predetermined value $T_{40}$, the process shifts to step S74, and if not, that is, if the fourth timer $T_4$ is at, or greater than, the fourth predetermined value $T_{40}$, shifts to step S75. The fourth predetermined value $T_{40}$ is set at a required conveyance time for which, as shown in FIG. 9, when the printing medium 2 is being conveyed at the predetermined conveyance speed, the conveyance-direction leading end and trailing end of the printing medium 2 set for the printing process pass through the position of the discharge paper sensor 21. That is, the conveyance-direction length of the printing medium 2 set for the printing process is obtained by multiplying the required conveyance time by the printing medium conveyance speed. The fourth predetermined value $T_{40}$ is stored in the memory of the controller for each conveyance-direction length of the printing medium 2 set for the printing process.

In step S74, the process determines whether or not the discharge paper sensor 21 has detected the printing medium 2. If the discharge paper sensor 21 has detected the printing medium 2, the process shifts to step S73 and, if not, returns to the main program.

Meanwhile, in step S75, supposing that the conveyance failure, that is, the so-called paper jam, occurs in the printing medium passing through the discharge paper sensor 21, the calculation process of FIG. 14, to be described hereafter, stops the printing process.

According to the calculation process, a required conveyance time from the discharge paper sensor 21 detecting the conveyance-direction leading end of the printing medium 2 until it detects the conveyance-direction trailing end of the relevant printing medium 2 is detected by the fourth timer $T_4$ and, when the required conveyance time is the fourth predetermined value (predetermined time) $T_{40}$ set in advance, or greater, the process determines that the printing medium conveyance failure has occurred, and stops the printing process.

Next, a description will be given of the calculation process of FIG. 14 which is carried out in step S45 of the calculation process of FIG. 10, step S55 of the calculation process of FIG. 11, step S65 of the calculation process of FIG. 12, and step S75 of the calculation process of FIG. 13.

In the calculation process, first, in step S81, the process stops the liquid ejection from the liquid ejection heads 11, and stops the printing.

Next, the process shifts to step S82, and energizes (in the figure, turns on) the tension solenoid 63 to separate the tension roller 5 from the conveyor belt 1.

Next, the process shifts to step S83, and stops the drive motor 33 for rotationally driving the conveyor belt 1.

Next, the process shifts to step S84 and, after carrying out a display of the occurrence of the paper jam on an unshown display portion, returns to the main program.

According to the calculation process, in the event that the calculation processes of FIGS. 10 to 13 detect the paper jam, after the liquid ejection from the liquid ejection heads 11 is stopped so as to stop the printing, the tension solenoid 63 is turned on to separate the tension roller 5 from the conveyor belt 1. As described heretofore, when the tension roller 5 is separated from the conveyor belt 1, as the drive roller 3 and the driven roller 4 are also separated from the conveyor belt 1 at the same time, the small-inertia conveyor belt 1, which has no more rotational drive force, stops within a very short time. Consequently, in a line head printing apparatus such as that of the embodiment, although a one-pass, high-speed printing is required, as it is possible, when the paper jam occurs, to stop the conveyor belt 1 within the short time, it is possible to avoid the printing medium 2 hitting the liquid ejection heads or being caught in a gap between the conveyor belt 1 and the liquid ejection heads. Also, as it is sufficient, after fixing the paper jam, merely to turn off the tension solenoid 63 to return the tension roller 5 to an original position, and to impart the tension to the conveyor belt 1, a recovery is easy.

In this way, according to the printing apparatus of the embodiment, as an arrangement is such that, when the printing medium 2 conveyance failure is detected, the tension solenoid 63 (a tension remover) removes the tension imparted to the conveyor belt 1 by the tension roller 5 (a tension imparter) as well as it being possible, when the paper jam occurs, to completely cut off the conveyor belt 1 from its large-inertia drive system and drive motor 33, and stop the small-inertia conveyor belt 1, which has lost the drive force, within the very short time, the recovery after fixing the paper jam is easy.

Also, as an arrangement is such as to stop the rotational drive of the conveyor belt 1 after the tension solenoid 63 (the tension remover) removes the tension imparted to the conveyor belt 1 by the tension roller 5 (the tension imparter), it is possible to, as well as reliably stopping the conveyor belt 1, control and prevent a slippage between the stopped conveyor belt 1 and the conveyor belt drive system.

Also, as an arrangement is such that the tension imparter configured of the tension roller 5 is moved in the direction away from the conveyor belt 1 to remove the tension imparted to the conveyor belt 1, as well as it being easy to carry out the invention, the recovery after fixing the paper jam is very easy.

In the embodiment, a detailed description has been given of only an example in which the invention is applied to the line head printing apparatus, but the printing apparatus of the invention is applicable to all types of printing apparatus including a multipass printing apparatus. Also, it is also acceptable that each portion configuring the printing apparatus of the invention is replaced with an optional configuration which can fulfill the same function, or that another optional configuration is added thereto.

Also, the liquid ejected from a liquid ejection device of the invention, not being limited in particular, can be a liquid (including a dispersion liquid such as a suspension or an emulsion) including, for example, following kinds of material. That is, it is an ink including a filter material of a color filter, a luminescence material for forming an EL luminescent layer in an organic EL (Electro Luminescence) device, a fluorescence material for forming a phosphor on an electrode in an electron emission device, a fluorescence material for forming a phosphor in a PDP (Plasma Display Panel) an electrophoretic body material for forming an electrophoretic body in an electrophoretic display device, a bank material for forming a bank on a surface of a substrate, various kinds of coating material, a liquid electrode material for forming an electrode, a particulate material configuring a spacer for configuring a minute cell gap between two substrates, a liquid metal material for forming a metal wire, a lens material for forming a microlens, a register material, a light diffusion material for forming a light diffuser, or the like.

Also, in the invention, it is also acceptable that the printing medium onto which the liquid is ejected, not being limited to paper such as recording paper, is another medium, such as a film, a woven fabric or a nonwoven fabric, or a work, such as a substrate like a glass substrate or a silicon substrate.

What is claimed is:

1. A printing apparatus which mounts a printing medium on a conveyor belt, conveys it to a printing area, and carries out printing by ejecting a liquid onto the printing medium from nozzles of a liquid ejection head, the apparatus comprising:

a tension imparter which imparts tension to the conveyor belt, a tension remover which removes the tension imparted to the conveyor belt by the tension imparter, a conveyance failure detector which detects a printing medium conveyance failure, and a conveyance failure controller which, when the printing medium conveyance failure is detected by the conveyance failure detector, causes the tension remover to remove the tension imparted to the conveyor belt by the tension imparter.

2. The printing apparatus according to claim 1, wherein the conveyance failure controller, after causing the tension remover to remove the tension imparted to the conveyor belt by the tension imparter, stops a rotational drive of the conveyor belt.

3. The printing apparatus according to claim 1, wherein the tension imparter is a tension roller.

4. The printing apparatus according to claim 1, wherein the tension remover removes the tension imparted to the conveyor belt by moving the tension roller in a direction away from the conveyor belt.

* * * * *

UNITED STATES PATENT AND TRADEMARK OFFICE

CERTIFICATE OF CORRECTION

PATENT NO. : 7,841,683 B2
APPLICATION NO. : 11/935927
DATED : November 30, 2010
INVENTOR(S) : Hiroshi Miyazawa It is certified that error appears in the above-identified patent and that said Letters Patent is hereby corrected as shown below:

On the Title Page, Item (73) Assignee:
change "Seiko Corporation" to --Seiko Epson Corporation--

Signed and Sealed this
Eighth Day of February, 2011

David J. Kappos

David J. Kappos
*Director of the United States Patent and Trademark Office*